US010851782B2

(12) United States Patent
Ashimori et al.

(10) Patent No.: US 10,851,782 B2
(45) Date of Patent: Dec. 1, 2020

(54) ROTARY-TYPE COMPRESSOR

(71) Applicant: Samsung Electronics Co., Ltd., Gyeonggi-do (KR)

(72) Inventors: Takeaki Ashimori, Kanagawa (JP); Osamu Aiba, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 409 days.

(21) Appl. No.: 15/536,642

(22) PCT Filed: Sep. 9, 2015

(86) PCT No.: PCT/KR2015/009479

§ 371 (c)(1),
(2) Date: Jun. 15, 2017

(87) PCT Pub. No.: WO2016/099002

PCT Pub. Date: Jun. 23, 2016

(65) Prior Publication Data

US 2017/0350394 A1 Dec. 7, 2017

(30) Foreign Application Priority Data

Dec. 15, 2014 (JP) ..... 2014-253125
Jan. 16, 2015 (JP) ..... 2015-006936
Jun. 30, 2015 (KR) ..... 10-2015-0092654

(51) Int. Cl.
*F04C 23/00* (2006.01)
*F04C 18/356* (2006.01)
*F04C 29/00* (2006.01)

(52) U.S. Cl.
CPC ..... *F04C 23/003* (2013.01); *F04C 18/3564* (2013.01); *F04C 23/001* (2013.01);
(Continued)

(58) Field of Classification Search
CPC ..... F04C 23/003; F04C 18/3564; F04C 29/0021; F04C 23/008; F04C 18/3562;
(Continued)

(56) References Cited

U.S. PATENT DOCUMENTS 6,447,274 B1 9/2002 Horihata et al.
2004/0071560 A1* 4/2004 Cho ..... F04C 23/001 417/223

(Continued)

FOREIGN PATENT DOCUMENTS

JP 357179396 A * 11/1982 ..... F04C 18/356
JP 0735071 A 2/1995

(Continued)

OTHER PUBLICATIONS 11.16 Dynamic Balancing of Multi-Plane Rotor; nptel.ac.in/courses/116102012/balancing%20of%20machines/dynamic%20balancing%20of%20multi%20plane%20rotor.html (Year: 2012).*

(Continued)

*Primary Examiner* — Patrick Hamo
*Assistant Examiner* — David N Brandt

(57) ABSTRACT

Disclosed herein is a rotary compressor capable of maintaining the overall dynamic balance and providing low vibration and low noise even at high speed operation and capable of improving efficiency by providing a communication passage to communicate operation chambers, which are provided inside each of the plurality of cylinders for compressing a refrigerant, to each other. The rotary-type compressor includes a housing, a drive motor provided inside the housing to generate power and having a stator and a rotor, and a compression unit that receives power from the drive motor and compresses the refrigerant. The compression unit includes a plurality of cylinders in which an operation chamber to compress the refrigerant is provided.

(Continued)

The operation chambers provided in each of the plurality of cylinders are provided to have different volumes, and a balancer provided to maintain dynamic balance is provided only in the lower side of the rotor.

20 Claims, 7 Drawing Sheets

(52) U.S. Cl.
CPC ..... *F04C 23/008* (2013.01); *F04C 29/0021* (2013.01); *F04C 29/0057* (2013.01); *F04C 2210/26* (2013.01); *F04C 2240/40* (2013.01); *F04C 2240/60* (2013.01); *F04C 2240/807* (2013.01); *F04C 2270/12* (2013.01); *F04C 2270/13* (2013.01)

(58) Field of Classification Search
CPC .... F04C 29/0057; F04C 23/02; F04C 23/001; F04C 2270/13; F04C 2240/807; F04C 2240/60; F04C 2270/12; F04C 2240/40; F04C 2210/26
See application file for complete search history.

(56) References Cited

U.S. PATENT DOCUMENTS

| | | | | |
|---|---|---|---|---|
| 2005/0019193 | A1* | 1/2005 | Lee | F04C 18/3564 418/23 |
| 2006/0056988 | A1* | 3/2006 | Seok | F04B 39/0055 417/273 |
| 2008/0240954 | A1* | 10/2008 | Morozumi | F04C 18/3564 418/13 |
| 2014/0096561 | A1* | 4/2014 | Hirayama | F04C 23/008 62/509 |

FOREIGN PATENT DOCUMENTS

| | | | | |
|---|---|---|---|---|
| JP | 2003227485 | * | 2/2002 | F04C 18/3564 |
| KR | 20-1999-0002723 | U | 1/1999 | |
| KR | 10-0452774 | B1 | 10/2004 | |
| KR | 10-2008-0061907 | A | 7/2008 | |

OTHER PUBLICATIONS

Translation of JP2003227485 (Year: 2002).*

* cited by examiner

ROTARY-TYPE COMPRESSOR

CROSS-REFERENCE TO RELATED APPLICATION(S) AND CLAIM OF PRIORITY

The present application claims priority under 35 U.S.C. § 365 to International Patent Application No. PCT/KR2015/009479 filed Sep. 9, 2015, entitled "ROTATING-TYPE COMPRESSOR". International Application PCT/KR2015/009479 claims priority under 35 U.S.C. § 365 to Japanese Patent Application Nos. 2014-253125, and 2015-006936, filed Dec. 15, 2014, and Jan. 16, 2015, respectively in the Japanese Intellectual Property Office; and Korean Patent Application No. 10-2015-0092654 filed in the Korean Intellectual Property Office on Jun. 30, 2015, the entire contents of each are incorporated herein by reference into the present disclosure as if fully set forth herein.

TECHNICAL FIELD

Embodiments disclosed herein relate to a rotary-type compressor used in an air conditioner or the like.

BACKGROUND

Generally, a compressor is a machine that receives power from an electric motor or a turbine or other power generating device to compress air, refrigerant or various other operating gases to increase the pressure. It is widely used in household appliances such as refrigerators and air conditioners or throughout the industry.

The compressor includes a reciprocating-type compressor in which a compression space in which a working gas is sucked and discharged between a piston and a cylinder is formed and the piston reciprocates linearly in the cylinder to compress the refrigerant, a rotary-type compressor in which a compression space in which a working gas is sucked and discharged between a rolling piston that rotates eccentrically and a cylinder is formed and the rolling piston eccentrically rotates along the inner wall of the cylinder to compress the refrigerant, and a scroll-type compressor in which a compression space in which a working gas is sucked and discharged between an orbiting scroll and a fixed scroll is formed and the orbiting scroll rotates along the fixed scroll to compress the refrigerant.

The rotary-type compressor having a plurality of cylinders maintains the static balance by making the displacement volume of the compressor uniform, and maintains the dynamic balance by installing a balancer at the upper and lower portions of the rotor.

However, there is a problem that a rotary shaft is deformed by the high-speed operation due to the expansion of the operation range of the compressor, and vibration and noise are generated due to the deflection of the rotary shaft. The deflection of the rotary shaft is mainly generated by the balancer provided in the upper side of the rotor.

SUMMARY

It is an aspect of the present disclosure to provide a rotary-type compressor capable of maintaining a dynamic balance as a whole and capable of allowing low vibration and low noise even at high speed operation.

It is another aspect of the present disclosure to provide a rotary-type compressor including a communication passage to communicate operation chambers, which are provided inside each of the plurality of cylinders for compressing a refrigerant, with each other to improve efficiency.

In accordance with an aspect of the present disclosure, a rotary-type compressor includes a housing, a drive motor provided inside the housing to generate power, and provided with a stator and a rotor and a compression unit to receive power from the drive motor to compress the refrigerant, the compression unit having a plurality of cylinders, each of which is provided with an operation chamber to compress the refrigerant therein. The operation chambers provided in each of the plurality of cylinders are configured to have different volumes, and a balancer to maintain dynamic balance is provided only in the lower side of the rotor.

The drive motor may include a rotary shaft to transmit rotation force of the rotor to the compression unit, and the cylinder may include a first cylinder provided in the lower side of the drive motor in the axial direction of the rotary shaft and a second cylinder provided between the drive motor and the first cylinder.

The volume of the operation chamber provided in the first cylinder may be larger than the volume of the operation chamber provided in the second cylinder.

The rotary shaft may include a shaft body to which the rotor is fixed, a first eccentric shaft disposed in the first cylinder so as to be eccentric from a central axis of the shaft body, and a second eccentric shaft disposed in the second cylinder to be eccentric with a phase difference of 180 degrees with the first eccentric shaft in the circumferential direction of the rotary shaft.

The compression unit may include a first piston inserted into the first eccentric shaft to rotate together with the rotary shaft, and a second piston inserted into the second eccentric shaft to rotate together with the rotary shaft.

If a mass obtained by adding a mass of the first eccentric shaft to a mass of the first piston is defined by m1, an eccentricity amount of the first eccentric shaft is defined by r1, and a distance from the lower end of the rotary shaft to the central axis of the first eccentric shaft is defined by L1, and if a mass obtained by adding a mass of the second eccentric shaft to a mass of the second piston is defined by m2, an eccentricity amount of the second eccentric shaft is defined by r2, and a distance from the lower end of the rotary shaft to the central axis of the second eccentric shaft is defined by L2, and if a mass of the balancer is defined by m3, a distance between the center of the balancer and the central axis of the rotary shaft is defined by r3, and a distance from the lower end of the rotary shaft to the center of the balancer is defined by L3, the following expression may be satisfied.

$$(m2\times r2\times L2-m1\times r1\times L1)\times m1\times r1\times L1/(m2\times r2\times L2)\leq m3\times r3\times L3\leq m2\times r2\times L2-m1\times r1\times L1$$

The first cylinder and the second cylinder may be each provided with a suction passage through which the refrigerant is sucked from the outside of the first cylinder and the second cylinder to the inside thereof, and a suction pipe to guide the refrigerant is inserted into the suction passage.

The suction passage may include a first suction passage provided in the first cylinder and a second suction passage provided in the second cylinder, and a communication passage communicating the first suction passage with the second suction passage may be provided between the first suction passage and the second suction passage.

The communication passage may communicate the first suction passage with the second suction passage in the downstream of the suction pipe.

The operation chamber may include a first operation chamber provided in the first cylinder and a second operation chamber provided in the second cylinder, wherein the first operation chamber and the second operation chamber may communicate with each other through the first suction passage, the communication passage, and the second suction passage.

when the volume change and the suction flow rate of a first suction chamber provided in the first operation chamber are large, a large amount of refrigerant maybe sucked through the first suction passage than the second suction passage, and when the volume change and the suction flow rate of a second suction chamber provided in the second operation chamber are large, a large amount of refrigerant may be sucked through the second suction passage than the first suction passage.

If a cross-sectional area of the suction pipe is defined by S (mm2), an displacement volume of the operation chamber is defined by V (cm3), an rotation speed of the drive motor is defined by N (rps), and if an evaluation value H is defined by a formula H=(V/S)X N, the evaluation value H may be in the range of $0.5 \leq H \leq 12$.

The cross-sectional S (mm2) of the suction pipe may be set to a value obtained by the formula $S=V \times Nr/3.5$ when a rated rotation speed of the drive motor is Nr (rps).

In accordance with another aspect of the present disclosure, a rotary-type compressor includes a housing, a drive motor provided inside the housing to generate power, and provided with a stator and a rotor and a compression unit that receives power from the drive motor and compresses the refrigerant. The compression unit includes a first cylinder provided under the drive motor and having a first operation chamber to compress the refrigerant therein, a second cylinder provided between the drive motor and the first cylinder and having a second operation chamber to compress the refrigerant therein, a first suction passage provided so that the refrigerant is sucked from the outside of the first cylinder to the first operation chamber, a second suction passage provided so that the refrigerant is sucked from the outside of the second cylinder to the second operation chamber and a communication passage communicating the first suction passage with the second suction passage.

The communication passage may include a first through hole provided in the first cylinder, a second through hole provided in the second cylinder, and a through hole communicating the first through hole and the second through hole.

The first operation chamber and the second operation chamber may communicate with each other through the first suction passage, the communication passage, and the second suction passage.

In accordance with another aspect of the present disclosure, a rotary-type compressor includes a housing, a drive motor provided inside the housing to generate power, and provided with a stator and a rotor and a compression unit that receives power from the drive motor and compresses the refrigerant. The compression unit includes a plurality of cylinders having operation chambers to compress the refrigerant, a plurality of suction passages provided in each of the plurality of cylinders to suck the refrigerant from the outside of the plurality of cylinders into the operation chambers and a plurality of suction pipes inserted into the plurality of suction passages to induce suction of the refrigerant. If a cross-sectional area of the suction pipe is defined by S (mm2), a displacement volume of the operation chamber is defined by V (cm3), a rotation speed of the drive motor is defined by N (rps), and if an evaluation value H is defined by a formula $H=(V/S) \times N$, the evaluation value H is in the range of $0.5 \leq H \leq 12$.

In accordance with one aspect of the present disclosure, it may be possible to maintain the overall dynamic balance and to achieve low vibration and low noise even at high speed operation.

In addition, the friction loss can be reduced by reducing the deflection of the rotating shaft and thus the efficiency can be improved.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Hereinafter, exemplary embodiments according to the present disclosure will be described in detail with reference to the accompanying drawings.

Figure 1:
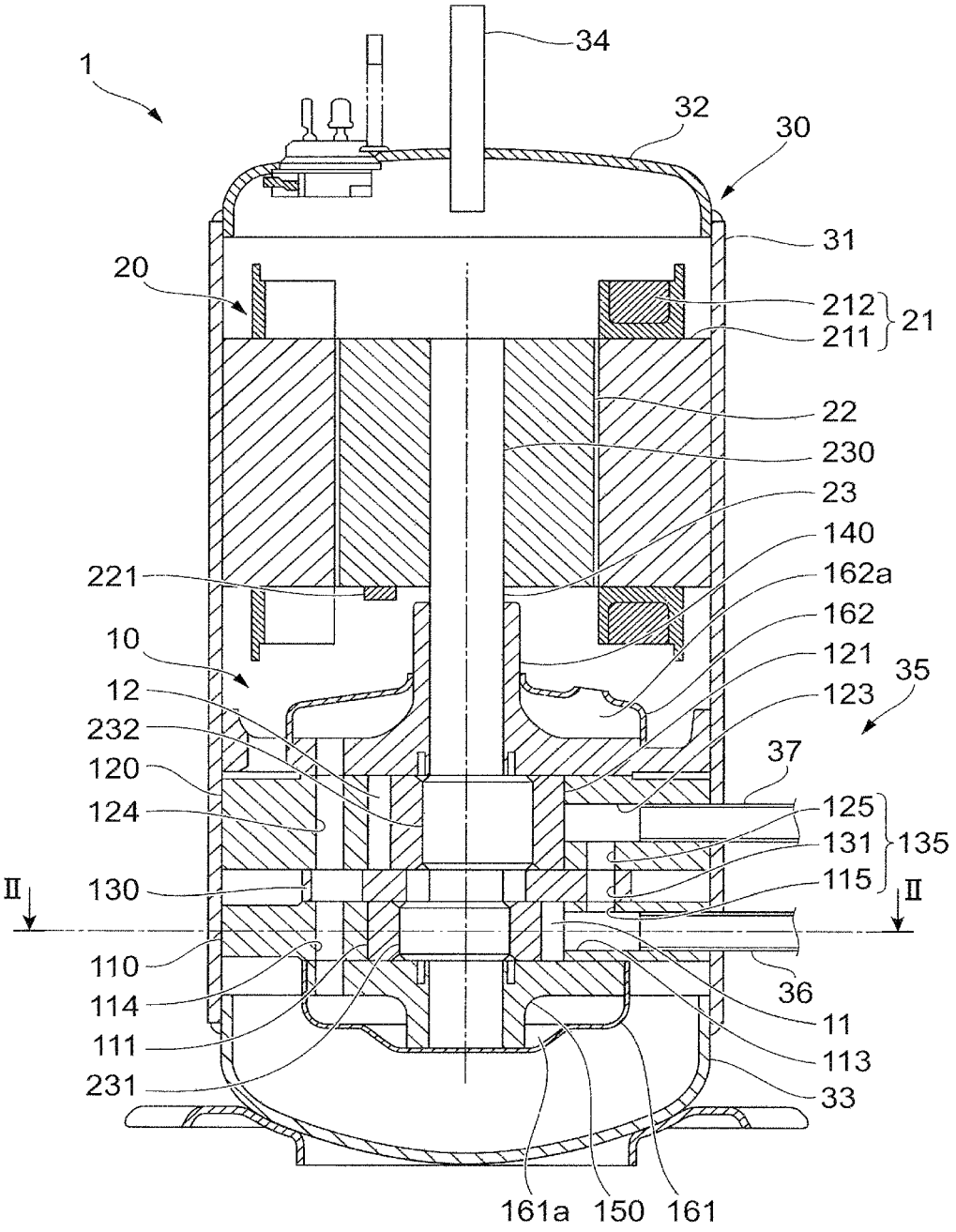
FIG. 1 is an axial cross-sectional view of a rotary-type compressor according to an embodiment of the present disclosure.
Figure 2:
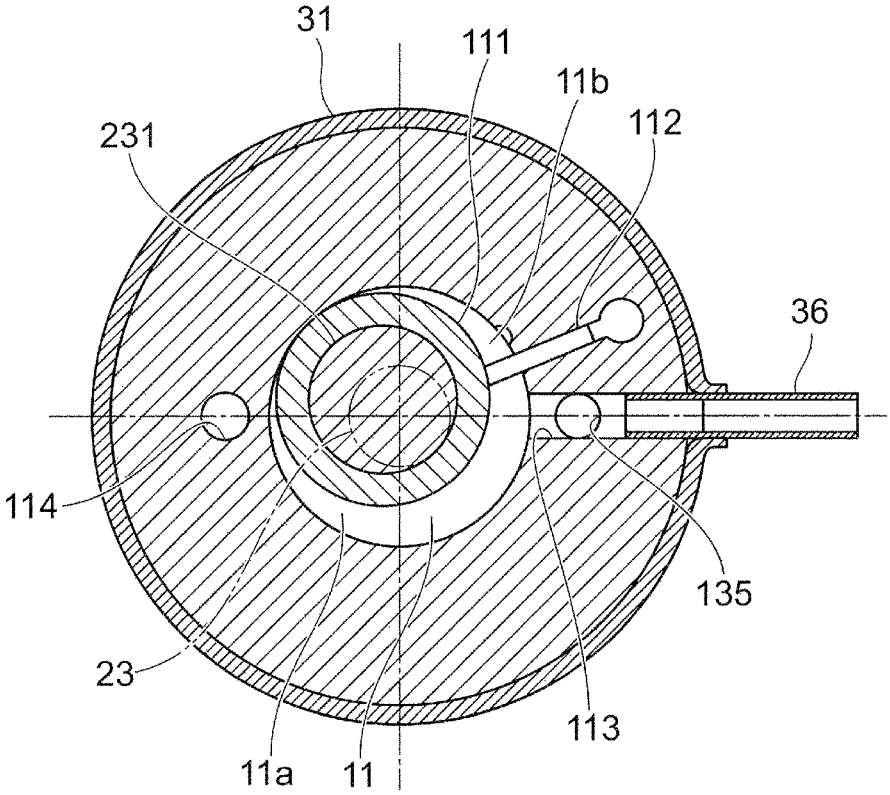
FIG. 2 is a cross-sectional view taken along line II-II of FIG. 1.

FIG. 1 is an axial cross-sectional view of a rotary-type compressor according to an embodiment of the present disclosure. FIG. 2 is a cross-sectional view taken along line II-II of FIG. 1.

A rotary-type compressor 1 is a compressor used in a refrigerant circuit such as an air conditioner.

The rotary-type compressor 1 includes a compression unit 10 for compressing a refrigerant, a drive motor 20 for driving the compression unit 10 and a housing 30 for accommodating the compression unit 10 and the drive motor 20. The rotary-type compressor 1 according to the present embodiment is a vertical-type compressor in which the axial direction of the rotary shaft 23, which will be described later, of the drive motor 20 is arranged in the gravity direction.

Hereinafter, the axial direction of the rotary shaft 23 will be referred to as "vertical direction", and the upper side may be referred to as "upper side" and the lower side may be referred to as "lower side" with reference to FIG. 1.

First, the drive motor 20 will be described.

The drive motor 20 is fixed to the housing 30 above the compression unit 10.

The drive motor 20 includes a stator 21, a rotor 22 and a rotary shaft 23 supporting the rotor 22 and rotating with respect to the housing 30.

The stator 21 has a stator main body 211 and a coil 212 wound on the stator main body 211.

The stator main body 211 is a laminated body in which a plurality of electromagnetic steel plates is stacked, and the approximate shape of the stator main body 211 is a cylindrical shape.

A diameter of an outer circumferential surface of the stator main body 211 is formed to be larger than a diameter of an inner circumferential surface of a central housing 31 of the housing 30, and the stator main body 211 is fitted in the central housing 31 in an interference fit. As a method of fitting the stator main body 211 into the central housing 31, a shrinkage fit or a press fit may be exemplified.

The stator main body 211 has a plurality of teeth (not shown) in the circumferential direction at a portion on the inner side facing the outer periphery of the rotor 22. The coil 212 is disposed in a notch (not shown) between adjacent tooth.

The rotor 22 is a laminated body in which a plurality of ring-shaped electromagnetic steel plates is stacked, and is generally cylindrical shape. A diameter of an inner peripheral surface of the rotor 22 is formed to be smaller than a diameter of an outer peripheral surface of the rotary shaft 23, and the rotor 22 is fitted in the rotary shaft 23 in an interference fit. As a method of fitting the rotary shaft 23 into the rotor 22, a press fitting can be exemplified. The rotor 22 is fixed to the rotary shaft 23 and rotates together with the rotary shaft 23. A diameter of an outer circumferential surface of the rotor 22 is smaller than a diameter of an inner circumferential surface of the stator main body 211 of the stator 21, and a clearance is formed between the rotor 22 and the stator 21.

The rotor 22 has a compression unit side balancer 221 on the surface facing the compressing unit 10 in the axial direction.

The rotary shaft 23 has a shaft main body 230 to which the rotor 22 is fitted and a first eccentric shaft 231 and a second eccentric shaft 232 which are provided at a lower portion of the shaft body 230, the first eccentric shaft 231 and the second eccentric shaft 232 each has an axis eccentric from the shaft central axis of the shaft body 230. The first eccentric shaft 231 is disposed so as to have a phase difference of 180 degrees with the second eccentric shaft 232 in the circumferential direction of the rotary shaft 23.

The shaft main body 230 is rotatably supported by a main bearing 140 which will be described later and a lower end portion of the shaft main body 230 is rotatably supported by a sub bearing 150 which will be described later.

Next, the housing 30 will be described.

The housing 30 has a cylindrical central housing 31 arranged at the center in the vertical direction, an upper housing 32 for covering the upper opening of the central housing 31 and a lower housing 33 for covering the lower opening of the central housing 31.

The housing 30 includes a discharge unit 34 for discharging a high-pressure refrigerant gas compressed by the compression unit 10 to an outside of the housing 30, and a suction unit 35 for sucking the refrigerant gas from the outside of the housing 30.

The stator 21 of the drive motor 20 and the main bearing 140 are fixed to the central housing 31. The suction unit 35 is formed by inserting a first suction pipe 36 and a second suction pipe 37, which will be described later, into a through hole formed in the central housing 31.

The upper housing 32 is formed in a convex bowl shape.

The discharge unit 34 is formed by inserting a tube into a through hole formed in the top portion of the upper housing 32.

The lower housing 33 is formed in a concave bowl shape.

The upper housing 32 and the lower housing 33 are fixed to the central housing 31.

Next, the compression unit 10 will be described.

The compression unit 10 includes a first cylinder 110, a second cylinder 120, and a disk-shaped partition 130 partitioning the first cylinder 110 and the second cylinder 120 each other.

The compression unit 10 includes the main bearing 140 disposed above the second cylinder 120 to cover the second cylinder 120 and rotatably supporting the rotation shaft 23.

The compression unit 10 includes the sub bearing 150 disposed below the first cylinder 110 to cover the first cylinder 110 and rotatably supporting the rotation shaft 23. The main bearing 140 is fixed to the central housing 31 of the housing 30 by welding or the like. The sub bearing 150 is fixed to the main bearing 140 by a fastening member such as a bolt.

The compression unit 10 includes a first cover 161 which forms a first discharge chamber 161*a* together with the sub bearing 150 and a second cover 162 which forms a second discharge chamber 162*a* together with the main bearing 140.

The compression unit 10 includes a first operation chamber 11 formed by the first cylinder 110, the partition 130 and the sub bearing 150, and a second operation chamber 12 formed by the second cylinder 120, the partition 130 and the main bearing 140.

The compression unit 10 is provided with a first piston 111 which is fitted in the first eccentric shaft 231 of the rotary shaft 23 and rotates together with the rotary shaft 23 in the first operation chamber 11, and a first vane 112 (see FIG. 2) elastically supported by a spring so as to be in constant contact with the first piston 111.

The first operation chamber 11 is partitioned into a first suction chamber 11*a* (see FIG. 2) and a first compression chamber 11*b* (see FIG. 2) by the first piston 111 and the first vane 112.

The compression unit 10 is provided with a second piston 121 which is fitted in the second eccentric shaft 232 of the rotary shaft 23 and rotates together with the rotary shaft 23 in the second operation chamber 12 and a second vane (not shown) elastically supported by a spring so as to be in constant contact with the second piston 121. The second operation chamber 12 is partitioned into a second suction chamber 12*a* (see FIG. 5B) and a second compression chamber (not shown) by the second piston 121 and the second vane (not shown), similar to the first operation chamber 11.

The first cylinder 110 is formed with a first suction passage 113 which penetrates the first cylinder 110 in the direction (radial direction) perpendicular to the axial direction of the rotary shaft 23 so as to communicate the first suction chamber 11*a* with the outside of the first cylinder 110. The first cylinder 110 is formed with a first discharge gas passage 114 penetrating the first cylinder 110 in the axial direction of the rotary shaft 23 outside the first operation chamber 11.

The second cylinder 120 is formed with a second suction passage 123 which penetrates the second cylinder 120 in the direction (radial direction) perpendicular to the axial direction of the rotary shaft 23 so as to communicate the second suction chamber 12*a* with the outside of the second cylinder 120. The second cylinder 120 is formed with a second discharge gas passage 124 penetrating the second cylinder 120 in the axial direction of the rotary shaft 23 outside the second operation chamber 12.

The compression unit 10 has a first suction pipe 36 having one end inserted into the first suction passage 113 and the other end connected to an accumulator, and a second suction pipe 37 having one end inserted into the second suction passage 123 and the other end connected to the accumulator.

The compression unit 10 according to the present embodiment has a communication passage 135 to communicate the first suction passage 113 with the second suction passage 123.

The communication passage 135 has an axial partitioning through hole 131 formed in the partition 130, a first through hole 115 formed in the first cylinder 110 to communicate the first suction passage 113 with the through hole 131, and a second through hole 125 formed in the second cylinder 120 to communicate the second suction passage 123 with the through hole 131.

In the compression unit 10 according to the present embodiment, the displacement volume V2 of the second operation chamber 12 of the second cylinder 120 close to the motor 20 in the axial direction is larger than the displacement volume V1 of the first operation chamber 11 of the first cylinder 110 far from the motor 20.

The displacement volume V1 of the first operation chamber 11 is approximately the volume of the space surrounded by an inner peripheral surface of the first cylinder 110 and an outer peripheral surface of the first piston 111. The displacement volume V2 of the second operation chamber 12 is approximately the volume of the space surrounded by an inner peripheral surface of the second cylinder 120 and an outer peripheral surface of the second piston 121.

In order to make the displacement volume V2 of the second operation chamber 12 larger than the displacement volume V1 of the first operation chamber 11, in the compression unit 10 according to the present embodiment, as shown in FIG. 1, a cross-sectional area of the first operation chamber 11 and a cross-sectional area of the second operation chamber 12 in the direction perpendicular to the axial direction, are the same and a size of the first operation chamber 11 and a size of the second operation chamber 12 are different from each other in the axial direction. That is, a length (thickness) in the axial direction of the second cylinder 120 and the second piston 121 is larger than a length (thickness) in the axial direction of the first cylinder 110 and the second piston 121.

Therefore, a balancer is not provided on a surface opposite to the surface facing the compression unit 10 of the rotor 22, which is a major cause of the deflection of the rotary shaft 23, thereby realizing low vibration and low noise.

The mass of the compression unit side balancer 221 of the rotary-type compressor 1 configured as described above according to this embodiment is set as follows.

Figure 3:
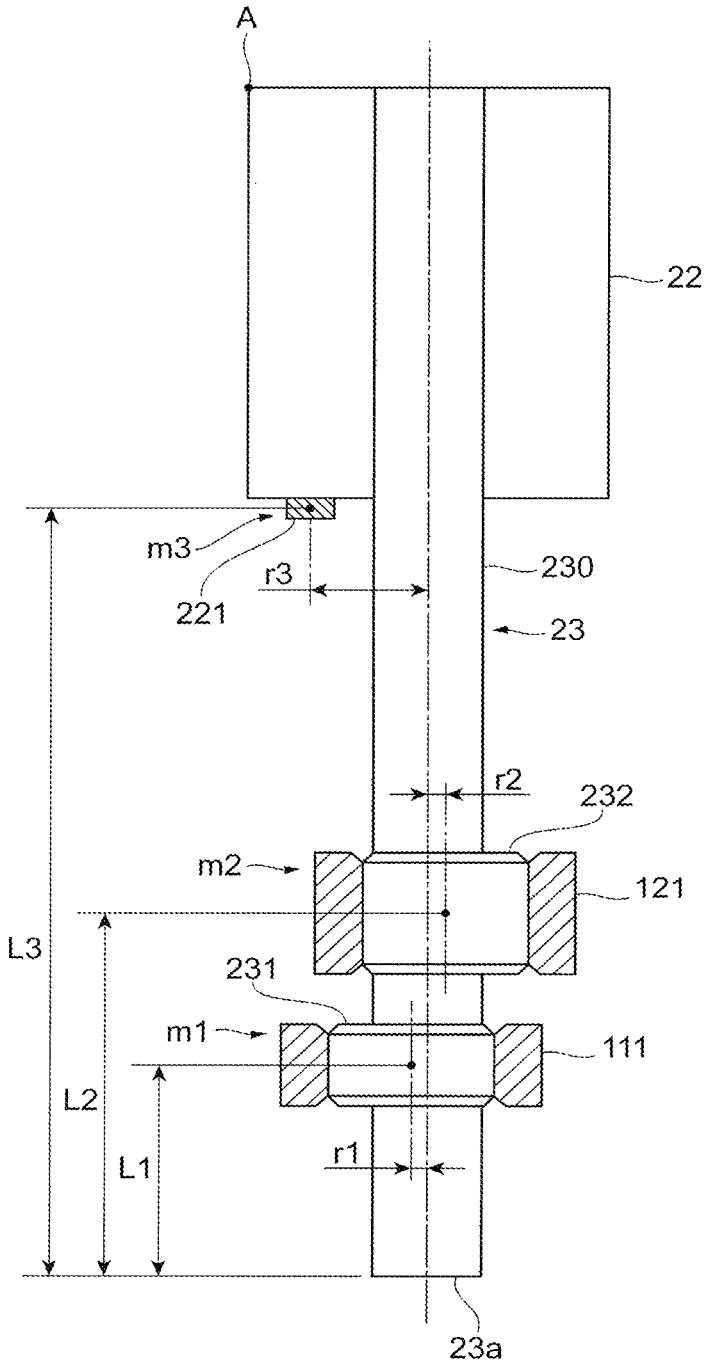
FIG. 3 is a view for explaining a balance according to an embodiment of the present disclosure.

FIG. 3 is a view for explaining the balancer.

A mass obtained by adding a mass of the first eccentric shaft 231 to a mass of the first piston 111 is defined by m1, an eccentricity amount of the first eccentric shaft 231 is defined by r1, and a distance from a distal end 23*a* of the rotary shaft 23 to the central axis of the first eccentric shaft 231 is defined by L1. A mass obtained by adding a mass of the second eccentric shaft 232 to a mass of the second piston 121 is defined by m2, an eccentricity amount of the second eccentric shaft 232 is defined by r2, and a distance from the distal end 23*a* of the rotary shaft 23 to the central axis of the second eccentric shaft 232 is defined by L2. a mass of the compression unit side balancer 221 is defined by m3, a distance between the center of the compression unit side balancer 221 and the central axis of the rotary shaft 23 is defined by r3, and a distance from the distal end 23*a* of the rotary shaft 23 to the center of the compression unit side balancer 221 is defined by L3, the following formula is satisfied.

In this case, a dynamic balance of the rotary-type compressor 1 according to a second embodiment is expressed by the following equation (1).

$$m2\times r2\times L2-m1\times r1\times L1=m3\times r3\times L3 \quad (1)$$

Even if the mass or the like of the compression unit side balancer 221 is set so that the dynamic balance is balanced, the axis of the rotor 22 is displaced due to slight deflection of the rotary shaft 23 due to manufacturing variation or the like, and thus the dynamic balance may become unbalanced.

Therefore, it is needed to minimize the deflection of the rotary shaft 23 particularly during high-speed operation.

Figure 4:
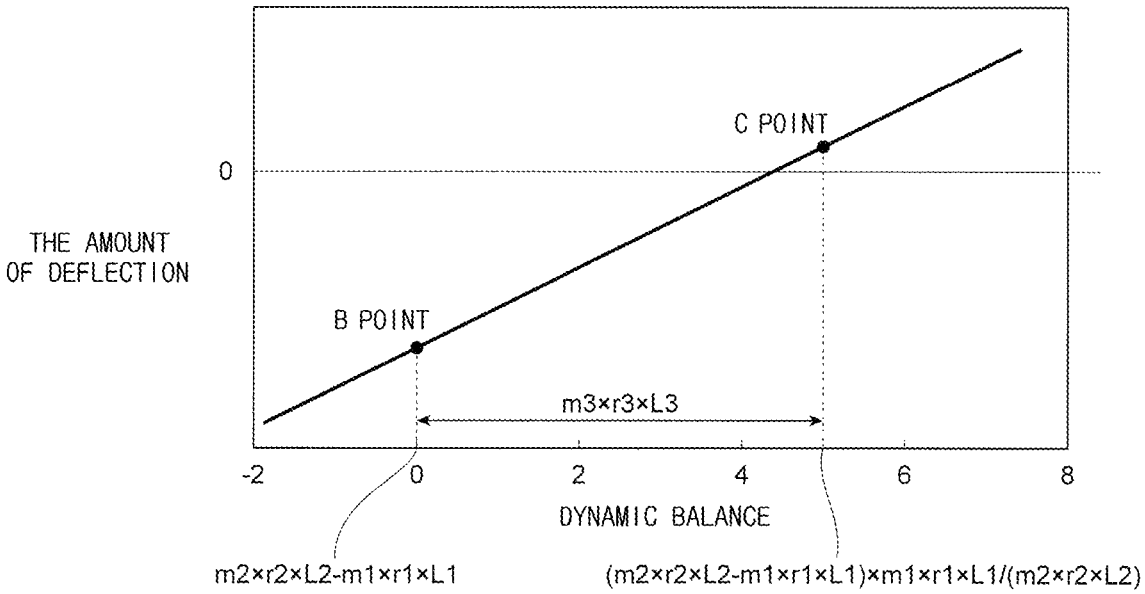
FIG. 4 is a graph showing the relationship between the dynamic balance and the amount of deflection at point A in FIG. 3 during high-speed operation according to an embodiment of the present disclosure.

FIG. 4 is a graph showing the relationship between the dynamic balance and the amount of deflection at a point A in FIG. 3 during high-speed operation.

The point A in FIG. 3 is an end portion of the rotor 22 opposite to the compression unit 10 in the axial direction, and is the outermost portion in the rotation radial direction. In FIG. 4, when the right side of the central axis of the rotary shaft 23 in FIG. 3 is positive and the left side of the central axis of the rotary shaft 23 is negative, the vertical axis represents the amount of deflection of the rotary shaft 23 at the point A, and the horizontal axis represents dynamic balance.

As shown in FIG. 4, as the dynamic balance shifts toward the positive side from zero, that is when the equation (1) is satisfied (a point B shown in FIG. 4), the amount of deflection of the point A gradually decreases and becomes zero. Further, as the dynamic balance shifts toward the positive side than the point at which the amount of deflection of the point A becomes zero, the amount of deflection of the point A gradually increases.

Because the amount of deflection of the rotary shaft 23 becomes larger as the values of m2×r2×L2 and m1×r1×L1 become larger, it can be seen that the amount of deflection of the rotary shaft 23 is reduced by setting the mass of the compression unit side balancer 221 to the value of the equation (2).

$$m3\times r3\times L3=(m2\times r2\times L2-m1\times r1\times L1)\times m1\times r1\times L1/(m2\times r2\times L2) \quad (2)$$

The amount of deflection of the rotary shaft 23 when the mass of the compression unit side balancer 221 satisfies the equation (2) is a point C shown in FIG. 4.

In view of the above, in the rotary-type compressor 1 according to the present embodiment, the mass of the compression unit side balancer 221 is set to satisfy the following expression (3).

$$(m2\times r2\times L2-m1\times r1\times L1)\times m1\times r1\times L1/(m2\times r2\times L2)$$

$$\leq m3\times r3\times L3\leq m2\times r2\times L2-m1\times r1\times L1 \quad (3)$$

In the rotary-type compressor 1 according to the present embodiment configured as described above, the balancer in the upper side of the rotor 22 which is a major cause of the deflection of the rotary shaft 23 is removed and the displacement volume of the respective compression chambers is formed to be unbalanced so as to balance the overall dynamic balance and realize the low vibration and the low noise during the high-speed operation. Further, the deflection of the rotary shaft 23 is reduced, and the friction loss can be reduced, so that the efficiency can be improved.

The rotary-type compressor 1 configured as above operates as follows.

When the rotary shaft 23 is driven by the drive motor 20, the first piston 111 and the second piston 121 rotate at a phase difference of 180 degrees with respect to each other as the first eccentric shaft 231 and the second eccentric shaft 232 rotate. By the eccentric rotation of the first piston 111 and the second piston 121, the first suction chamber 11*a* and the second suction chamber 12*a* and the first compression chamber 11*b* and the second compression chamber (not shown) in the first operation chamber 11 and the second operation chamber 12 are repeatedly reduced and expanded.

When the first suction chamber 11*a* and the second suction chamber 12*a* are expanded, the refrigerant gas supplied from the refrigeration cycle through the first suction pipe 36 and the second suction pipe 37 is sucked through the first suction passage 113 and the second suction passage 123. The suction operation will be described later in detail.

A first end of the communication passage 135 terminates at the first suction passage 113 and a second end of the communication passage 135 terminates at the second suction passage 123. A diameter D1 of the first end of the communication passage 135 and a diameter D2 of the second end of the communication passage 135 are equal to a diameter D3 of the first suction passage 113 and a diameter D4 of the second suction passage 123, respectively.

The refrigerant gas sucked into the first suction chamber 11*a* is compressed by reducing the first compression chamber 11*b* and the refrigerant gas is discharged to the first discharge chamber 161*a* when the pressure becomes a predetermined discharge pressure. The refrigerant gas sucked into the second suction chamber 12*a* is compressed by reducing the second compression chamber (not shown), and the refrigerant gas is discharged to the second discharge chamber 162*a* when the pressure becomes a predetermined discharge pressure.

The refrigerant gas is alternately compressed by the first and second operation chambers 11 and 12 and discharged into the housing 30 through the first discharge chamber 161*a* and the second discharge chamber 162*a*. The refrigerant gas discharged to the housing 30 is discharged to the refrigeration cycle through the discharge unit 34.

The suction operation will be described in detail.

Figure 5A:
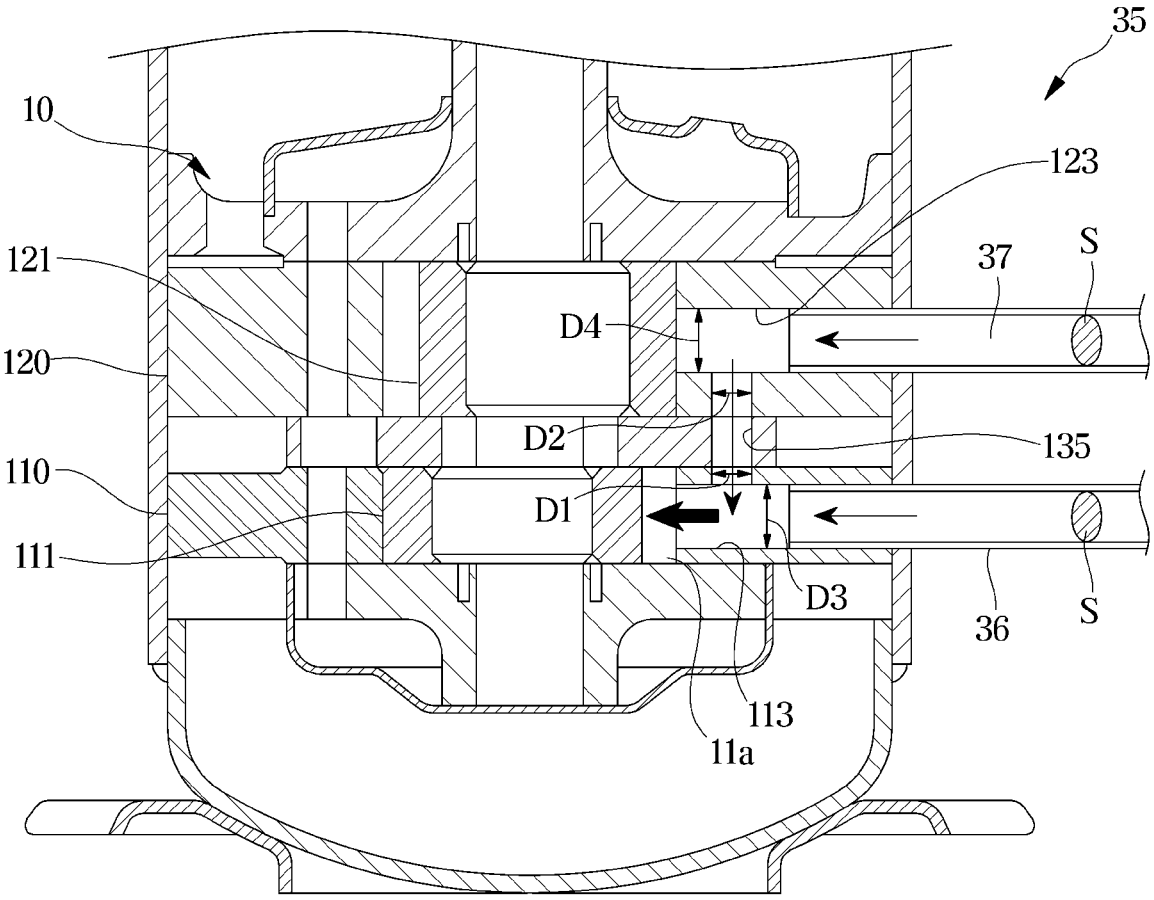
FIG. 5A is a view showing a state in which refrigerant gas is sucked into a first suction chamber according to an embodiment of the present disclosure.
Figure 5B:
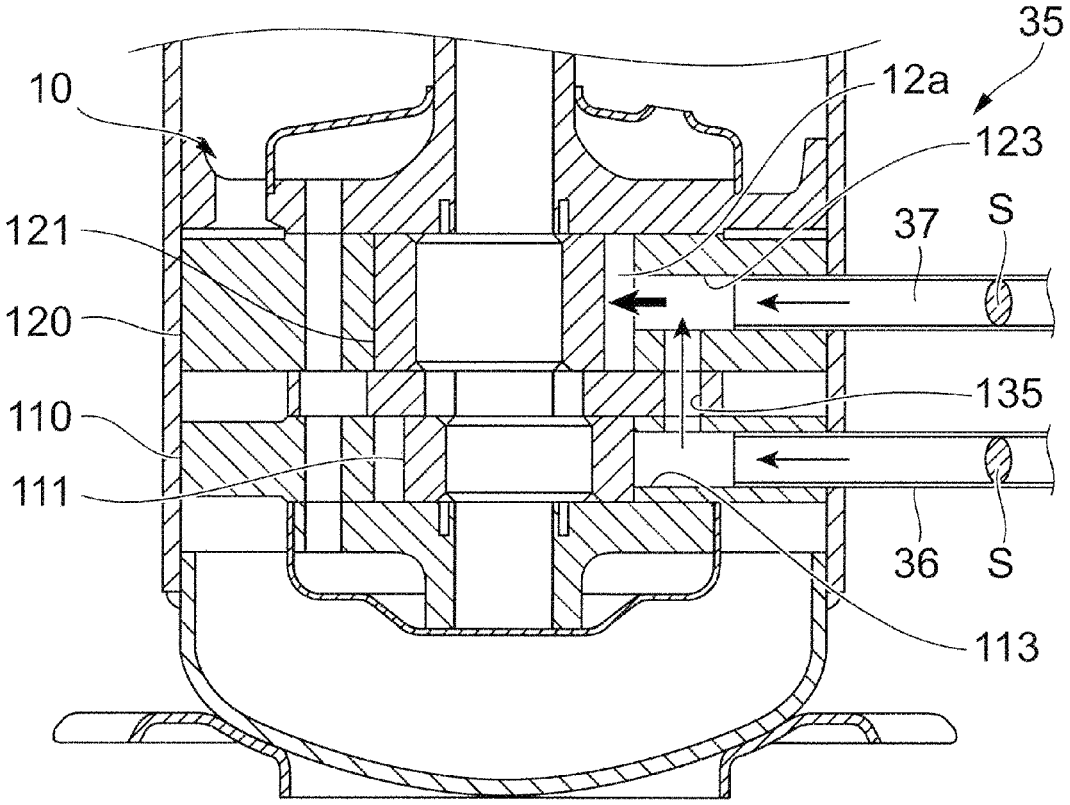
FIG. 5B is a view showing a state in which refrigerant gas is sucked into a second suction chamber according to an embodiment of the present disclosure.

FIG. 5A is a view showing a state in which the refrigerant gas is sucked into the first suction chamber 11*a*, and FIG. 5B is a view showing a state in which the refrigerant gas is sucked into the second suction chamber 12*a*.

In the rotary-type compressor 1 according to the present embodiment, the first suction chamber 11*a* and the second suction chamber 12*a* communicate with each other through the first suction passage 113, the communication passage 135 and the second suction passage 123. The first suction chamber 11*a* communicates with the second suction pipe 37 through the first suction passage 113, the communication passage 135 and the second suction passage 123. The second suction chamber 12*a* communicates with the first suction pipe 36 through the second suction passage 123, the communication passage 135 and the first suction passage 113.

According to this configuration, when the volume change of the first suction chamber 11*a* is large and the suction flow rate is large, the refrigerant gas mainly flows from the first suction pipe 36 to the first suction chamber 11*a* through the first suction passage 113. When the volume change of the first suction chamber 11*a* is large and the suction flow rate is large, the refrigerant gas is also sucked into the first suction chamber 11*a* from the second suction pipe 37 through the second suction passage 123, the communication passage 135 and the first suction passage 113 (See FIG. 5A).

At this time, the volume change of the second suction chamber 12*a* is small because the phase is shifted by 180 degrees, and the suction flow rate of the second suction chamber 12*a* is small.

When the volume change of the second suction chamber 12*a* is large and the suction flow rate is large, the refrigerant gas mainly flows from the second suction pipe 37 to the second suction chamber 12*a* through the second suction passage 123. When the volume change of the second suction chamber 12*a* is large and the suction flow rate is large, the refrigerant gas is also sucked into the second suction chamber 12*a* from the first suction pipe 36 through the first suction passage 113, the communication passage 135 and the second suction passage 123 (See FIG. 5B).

At this time, the volume change of the first suction chamber 11*a* is small because the phase is shifted by 180 degrees, and the suction flow rate of the first suction chamber 11*a* is small.

In the rotary-type compressor 1 according to the present embodiment, the phase of the maximum value of the suction flow rate of the first suction chamber 11*a* and the phase of the maximum value of the suction flow rate of the second suction chamber 12*a* are 180 degrees shifted from each other although the volume change is large and the change in the suction flow rate during a single rotation is large.

In the rotary-type compressor 1 according to the present embodiment, the first suction passage 113 connected to the first suction chamber 11*a* and the second suction passage 123 connected to the second suction chamber 12*a* communicate with each other through the communication passage 135. Therefore, one of the first suction chamber 11*a* and the second suction chamber can suck the refrigerant gas from both the first suction pipe 36 and the second suction pipe 37, and the suction loss due to the flow resistance in the first suction pipe 36 and the second suction pipe 37 is reduced.

However, a pressure pulsation occurs in the first suction passage 113 and the second suction passage 123 due to the volume change of the first suction chamber 11*a* and the second suction chamber 12*a*. Therefore, if there is a communication passage 135 for communicating the first suction passage 113 with the second suction passage 123, one of the first suction chamber 11*a* and the second suction chamber 12*a* may be influenced by the pressure pulsation of the other suction chamber, and the suction may become unstable or the suction flow rate may be lowered. As a result, the efficiency may be lowered.

Taking these points into account, it is possible to define an evaluation value H by the following expression (4) and the specification of the rotary-type compressor 1 may be set based on the evaluation value H.

$$H=(V/S)\times N \tag{4}$$

S is a cross-sectional area (mm2) (see FIG. 5A) of the first suction pipe 36 and the second suction pipe 37, and N is a rotation per second (rps) of the drive motor 20. V is the displacement volume (cm3) of each operation chamber of the compression unit 10. In the present embodiment, although the displacement volume V2 of the second operation chamber 12 is larger than the displacement volume V1 of the first operation chamber 11, in the expression (4), the displacement volume V1 of the first operation chamber 11 and the displacement volume V2 of the second operation chamber 12 are equal to each other.

Figure 6:
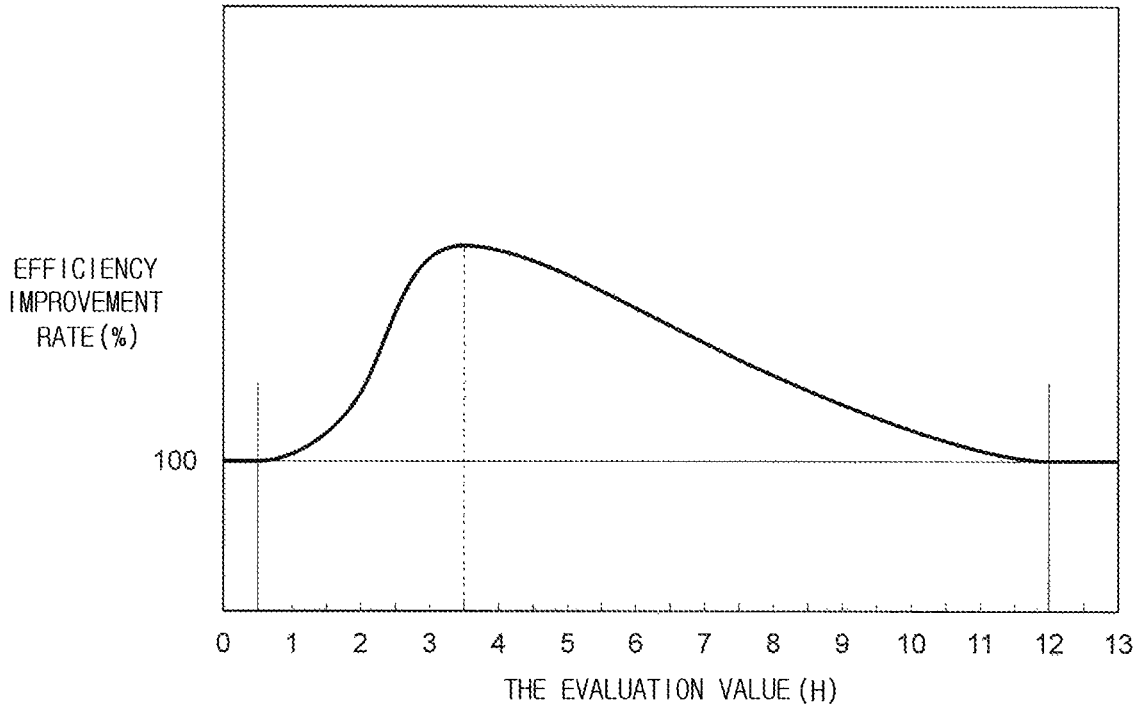
FIG. 6 is a graph showing the relationship between the evaluation value H and the efficiency improvement ratio according to an embodiment of the present disclosure.

FIG. 6 is a graph showing the relationship between the evaluation value H and the efficiency improvement ratio (%).

As shown in FIG. 6, it is derived that the efficiency of the rotary-type compressor 1 is improved (100% or more) when the range of the evaluation value H is $0.5 \leq H \leq 12$.

When the evaluation value H is less than 0.5 (for example, when the N is small), since the suction loss is small in the suction of the refrigerant gas, the efficiency improvement effect is small even if the communication passage 135 is provided.

Meanwhile, when the evaluation value H is larger than 12 (for example, the N is large), the switching of the flow direction of the refrigerant gas flowing through the communication passage 135 is not performed smoothly even if the communication passage 135 is provided, and thus the effect of reducing the suction loss is reduced and the efficiency improvement effect is small.

Therefore, the rotary-type compressor 1 according to the present embodiment is set such that the range of the evaluation value H is $0.5 \leq H \leq 12$.

The low-speed rotation speed Nmin (rps), the high-speed rotation speed Nmax (rps), and the cylinder volume (displacement volume) V (cm3) of each cylinder (operation chamber) of the compression unit 10 are determined in accordance with the specification of the rotary-type compressor 1. Therefore, the cross-sectional area S (mm2) of the first suction pipe 36 and the second suction pipe 37 is set so that the following expression (5) is satisfied.

$$(V\times\text{min})/0.5 \leq S \leq (V\times\text{max})/12 \quad (5)$$

For example, when the rated rotation speed of the rotary-type compressor 1 is Nr (rps), the cross-sectional area S (mm2) of the first suction pipe 36 and the second suction pipe 37 may be set ($S=V\times Nr/3.5$) so that the evaluation value H is 3.5 where the efficiency improvement rate is maximized shown in FIG. 6.

In the rotary-type compressor 1 according to the present embodiment, the evaluation values H1 and H2 are set to the following equations (6) and (7), and the ranges of the evaluation values H1 and H2 are set to satisfy $0.5 \leq H1 \leq 12$ and $0.5 \leq H2 \leq 12$.

$$H1=(V1/S)\times N \quad (6)$$

$$H2=(V2/S)\times N \quad (7)$$

The low-speed rotation speed Nmin (rps), the high-speed rotation speed Nmax (rps), and the displacement volume V1, and V2 (cm3) of each cylinder (operation chamber) of the compression unit 10 are determined in accordance with the specification of the rotary-type compressor 1 according to the present embodiment. Therefore, the cross-sectional area S (mm2) of the first suction pipe 36 and the second suction pipe 37 is set so that the following expressions (8), and (9) are satisfied.

$$(V1\times N\text{min})/0.5 \leq S \leq (V1\times N\text{max})/12 \quad (8)$$

$$(V2\times N\text{min})/0.5 \leq S \leq (V2\times N\text{max})/12 \quad (9)$$

For example, when the rated rotation speed of the rotary-type compressor 1 is Nr (rps), the cross-sectional area S (mm2) of the first suction pipe 36 and the second suction pipe 37 may be set ($S=V1\times Nr/3.5$ or $S=V2\times Nr/3.5$, or $V2\times Nr/3.5 \leq S \leq V1\times Nr/3.5$) so that the evaluation value H is 3.5 where the efficiency improvement rate is maximized shown in FIG. 6.

The rotary-type compressor 1 configured as described above has the communication passage 135 that communicates the first suction passage 113 with the second suction passage 123, and the range of the evaluation value H determined from the equation (4) is set so as to satisfy $0.5 \leq H \leq 12$, so that the efficiency is high. In other words, the efficiency of the rotary-type compressor 1 can be increased by setting the range of the evaluation value H to satisfy $0.5 \leq H \leq 12$ and forming the communication passage 135 communicating with the first suction pipe 36 and the second suction pipe 37.

When the displacement volume V2 of the compression unit 10 is larger than the displacement volume V1, there is a possibility that the suction loss of the first suction chamber 11*a* with a small volume change becomes large. However the rotary-type compressor 1 according to the second embodiment includes the communication passage 135 communicating with the first suction pipe 36 and the second suction pipe 37 and the range of the evaluation value H is set so as to satisfy $0.5 \leq H \leq 12$, thereby increasing the efficiency.

Although a few embodiments of the present disclosure have been shown and described, it would be appreciated by those skilled in the art that various changes may be made in these embodiments without departing from the spirit and scope of the disclosure as defined in the claims.

The invention claimed is:

1. A rotary-type compressor comprising: a housing; a drive motor provided inside the housing and provided with a stator and a rotor; and a compression unit configured to compress a refrigerant by being driven by the drive motor, the compression unit including: a plurality of cylinders, each of which is provided with an operation chamber to compress the refrigerant therein; a plurality of suction passages to bring the refrigerant into the plurality of cylinders, respectively; and a communication passage configured to communicate a first of the plurality of suction passages with a second of the plurality of suction passages, the communication passage being upstream of the operation chambers, a first end of the communication passage terminating at the first of the plurality of suction passages, a second end of the communication passage terminating at the second of the plurality of suction passages, wherein a diameter of the first end of the communication passage and a diameter of the second end of the communication passage are equal to a diameter of the first of the plurality of suction passages and of the second of the plurality of suction passages, respectively, wherein the operation chambers provided in each of the plurality of cylinders are configured to have different volumes, and wherein a balancer to maintain dynamic balance is provided in a lower side of the rotor.

2. The rotary-type compressor according to claim 1, wherein:

the drive motor further includes a rotary shaft to transmit rotation force of the rotor to the compression unit, and the plurality of cylinders include:

a first cylinder provided in a lower side of the drive motor in an axial direction of the rotary shaft, and a second cylinder provided between the drive motor and the first cylinder.

3. The rotary-type compressor according to claim 2, wherein a first volume of a first operation chamber provided in the first cylinder is smaller than a second volume of a second operation chamber provided in the second cylinder.

4. The rotary-type compressor according to claim 3, wherein the rotary shaft includes:

a shaft body to which the rotor is fixed, a first eccentric shaft disposed in the first cylinder so as to be eccentric from a central axis of the shaft body, and a second eccentric shaft disposed in the second cylinder to be eccentric with a phase difference of 180 degrees with the first eccentric shaft in a circumferential direction of the rotary shaft.

5. The rotary-type compressor according to claim 4, wherein the compression unit includes:

a first piston inserted around the first eccentric shaft to rotate together with the rotary shaft, and a second piston inserted around the second eccentric shaft to rotate together with the rotary shaft.

6. The rotary-type compressor according to claim 5, wherein if a mass obtained by adding a mass of the first eccentric shaft to a mass of the first piston is defined by ml, an eccentricity amount of the first eccentric shaft is defined by r1, and a distance from a lower end of the rotary shaft to the central axis of the first eccentric shaft is defined by L1, and if a mass obtained by adding a mass of the second eccentric shaft to a mass of the second piston is defined by m2, an eccentricity amount of the second eccentric shaft is defined by r2, and a distance from the lower end of the rotary shaft to the central axis of the second eccentric shaft is defined by L2, and if a mass of the balancer is defined by m3, a distance between a center of the balancer and the central axis of the rotary shaft is defined by r3, and a distance from the lower end of the rotary shaft to the center of the balancer is defined by L3, the following expression is satisfied $$(m2\times r2\times L2-m1\times r1\times L1)\times m1\times r1\times L1/(m2\times r2\times L2)\leq m3\times r3\times L3\leq m2\times r2\times L2-m1\times r1\times L1.$$

7. The rotary-type compressor according to claim 2, wherein:

the first cylinder and the second cylinder are each provided with the first and the second of the plurality of suction passages, respectively, through which the refrigerant is sucked from an outside of the first cylinder and the second cylinder to an inside thereof, and a first and a second suction pipe to guide the refrigerant is inserted into the respective first and second plurality of suction passages.

8. The rotary-type compressor according to claim 7, wherein the communication passage is configured to communicate the first of the plurality of suction passages with the second of the plurality of suction passages downstream of the first and second suction pipes.

9. The rotary-type compressor according to claim 8, wherein:

the operation chambers include a first operation chamber provided in the first cylinder and a second operation chamber provided in the second cylinder, the first operation chamber and the second operation chamber communicate with each other through the first of the plurality of suction passages, the communication passage, and the second of the plurality of suction passages.

10. The rotary-type compressor according to claim 9, wherein:

when a volume change and a suction flow rate of a first suction chamber provided in the first operation chamber are larger than a volume change and a suction flow rate of a second suction chamber provided in the second operation chamber, a larger amount of refrigerant is sucked through the first of the plurality of suctions passage than the second of the plurality of suction passages, and when the volume change and the suction flow rate of the second suction chamber provided in the second operation chamber are larger than the volume change and the suction flow rate of the first suction chamber provided in the first operation chamber, a larger amount of refrigerant is sucked through the second of the plurality of suction passages than the first of the plurality of suction passages.

11. The rotary-type compressor according to claim 7, wherein:

if a cross-sectional of any of the suction pipes is defined by S ($mm^2$), a displacement volume of any of the operation chambers is defined by V ($cm^3$), a rotation speed of the drive motor is defined by N (rps), and if an evaluation value H is defined by a formula H =(V/S) X N, the evaluation value H is in a range of 0.5\frac{cm^3 }{mm^2}rps≤H≤12\frac{cm ^3}{mm ^2}rps.

12. The rotary-type compressor according to claim 11, wherein the cross-sectional S ($mm^2$) of any of the suction pipes is set to a value obtained by a formula S=V×Nr/(3.5\frac {cm^3}{mm^2}rps) when a rated rotation speed of the drive motor is Nr (rps).

13. An air conditioner comprising: a rotary-type compressor including: a housing; a drive motor provided inside the housing, and provided with a stator and a rotor; and a compression unit configured to compress a refrigerant by being driven by the drive motor, the compression unit including: a plurality of cylinders, each of which is provided with an operation chamber to compress the refrigerant therein; a plurality of suction passages to bring the refrigerant into the plurality of cylinders, respectively; and a communication passage configured to communicate a first of the plurality of suction passages with a second of the plurality of suction passages, the communication passage being upstream of the operation chambers, a first end of the communication passage terminating at the first of the plurality of suction passages, a second end of the communication passage terminating at the second of the plurality of suction passages, wherein a diameter of the first end of the communication passage and a diameter of the second end of the communication passage are equal to a diameter of the first of the plurality of suction passages and of the second of the plurality of suction passages, respectively, wherein the operation chambers provided in each of the plurality of cylinders are configured to have different volumes, and wherein a balancer to maintain dynamic balance is provided in a lower side of the rotor.

14. The air conditioner of claim 13, wherein:

the drive motor further includes a rotary shaft to transmit rotation force of the rotor to the compression unit, and the plurality of cylinders include:

a first cylinder provided in a lower side of the drive motor in an axial direction of the rotary shaft, and a second cylinder provided between the drive motor and the first cylinder.

15. The air conditioner of claim 14, wherein a first volume of a first operation chamber provided in the first cylinder is smaller than a second volume of a second operation chamber provided in the second cylinder.

16. The air conditioner of claim 15, wherein the rotary shaft includes:

a shaft body to which the rotor is fixed, a first eccentric shaft disposed in the first cylinder so as to be eccentric from a central axis of the shaft body, and a second eccentric shaft disposed in the second cylinder to be eccentric with a phase difference of 180 degrees with the first eccentric shaft in a circumferential direction of the rotary shaft.

17. The air conditioner of claim 16, wherein the compression unit includes:

a first piston inserted around the first eccentric shaft to rotate together with the rotary shaft, and a second piston inserted around the second eccentric shaft to rotate together with the rotary shaft.

18. The air conditioner of claim 14, wherein:

the first cylinder and the second cylinder are each provided with the first and the second of the plurality of suction passages, respectively, through which the refrigerant is sucked from an outside of the first cylinder and the second cylinder to an inside thereof, and a first and a second suction pipe to guide the refrigerant is inserted into the respective first and second plurality of suction passages.

19. The air conditioner of claim 18, wherein the communication passage is configured to communicate the first of the plurality of suction passages with the second of the plurality of suction passages downstream of the first and second suction pipes.

20. The air conditioner of claim 19, wherein:

the operation chambers include a first operation chamber provided in the first cylinder and a second operation chamber provided in the second cylinder, the first operation chamber and the second operation chamber communicate with each other through the first of the plurality of suction passages, the communication passage, and the second of the plurality of suction passages.

* * * * *